US008790222B2

(12) United States Patent
Burger

(10) Patent No.: US 8,790,222 B2
(45) Date of Patent: Jul. 29, 2014

(54) SINGLE BELT OMNI DIRECTIONAL TREADMILL

(76) Inventor: George Burger, Rocklin, CA (US)

( * ) Notice: Subject to any disclaimer, the term of this patent is extended or adjusted under 35 U.S.C. 154(b) by 3 days.

(21) Appl. No.: 13/193,511

(22) Filed: Jul. 28, 2011

(65) Prior Publication Data

US 2012/0302408 A1 Nov. 29, 2012

Related U.S. Application Data

(60) Provisional application No. 61/400,535, filed on Jul. 29, 2010.

(51) Int. Cl.
*A63B 22/02* (2006.01)
*A63B 22/00* (2006.01)

(52) U.S. Cl.
USPC ..... 482/54; 482/51

(58) Field of Classification Search
USPC ..... 482/43, 51, 54; 193/35 MD; 198/417, 198/778; 700/119; 434/247
See application file for complete search history.

(56) References Cited

U.S. PATENT DOCUMENTS

| | | | | |
|---|---|---|---|---|
| 3,451,526 | A | 6/1969 | Fernandez | |
| 5,385,520 | A | 1/1995 | Lepine et al. | |
| 5,667,461 | A | 9/1997 | Hall | |
| 6,042,514 | A * | 3/2000 | Abelbeck | 482/54 |
| 6,053,848 | A | 4/2000 | Eschenbach | |
| 6,123,647 | A * | 9/2000 | Mitchell | 482/54 |
| 6,152,854 | A * | 11/2000 | Carmein | 482/4 |
| 6,409,633 | B1 * | 6/2002 | Abelbeck | 482/54 |
| 6,554,747 | B1 * | 4/2003 | Rempe | 482/38 |
| 6,743,154 | B2 * | 6/2004 | Epstein | 482/54 |
| 6,821,230 | B2 * | 11/2004 | Dalebout et al. | 482/51 |
| 7,624,858 | B2 * | 12/2009 | Delair et al. | 198/778 |
| 7,780,573 | B1 * | 8/2010 | Carmein | 482/4 |
| 2005/0233865 | A1 * | 10/2005 | Reiffel | 482/54 |
| 2010/0022358 | A1 | 1/2010 | Schwaiger et al. | |
| 2010/0147430 | A1 | 6/2010 | Shultz | |
| 2010/0304936 | A1 * | 12/2010 | Wang | 482/54 |
| 2011/0017576 | A1 * | 1/2011 | Andersen | 198/778 |

FOREIGN PATENT DOCUMENTS

WO 9734663 A1 9/1997

OTHER PUBLICATIONS

International Search Report and Written Opinion dated Jan. 3, 2012 in corresponding International patent application No. PCT/US2011/045875, 7 pages.

* cited by examiner

*Primary Examiner* — Loan H Thanh
*Assistant Examiner* — Gregory Winter
(74) *Attorney, Agent, or Firm* — The Webb Law Firm

(57) ABSTRACT

A treadmill having a belt assembly allows a user the walk or run in any direction. A single helically wound belt over a flattened torus is powered by two independent drive systems. The drive systems are controlled by a combination of infrared cameras and a physical harness system.

9 Claims, 17 Drawing Sheets

SECTION B–B

SECTION A–A

SECTION B–B

SECTION C–C

Section D–D

Section F–F

Section E–E

SINGLE BELT OMNI DIRECTIONAL TREADMILL

RELATED APPLICATIONS

The present application claims priority to U.S. Provisional Application Ser. No. 61/400,535, filed on Jul. 29, 2010, the entirety of which is incorporated by reference herein.

BACKGROUND

1. Field of the Invention

The present invention relates to a treadmill that can be walked on in any direction without physically moving from one small area. The treadmill of the present invention will be able to greatly enhance the immerging technology of immersive virtual reality along with many other technologies.

2. Description of Related Art

Several types of omni-directional treadmills or similar functioning devices are known. One such treadmill is disclosed in U.S. Pat. No. 7,780,573 and employs a plurality of high aspect ratio endless unpowered treadmills fixed together transverse to the plane of belt rotation enabling them to move together like the treads of a tank. The plurality of treadmills is then powered by having them pass over several omni-directional wheels that power the multitude of treadmills while allowing them to pass across the omni-directional wheels.

Another larger omni-directional treadmill is disclosed in U.S. Pat. Publication No. 20100022358 and uses the same concept of attaching a plurality of endless treadmills together and again move them like the treads of a tank.

SUMMARY

Unlike the prior art as exemplified by U.S. Pat. No. 7,780,573 which requires multiple belts, the present invention is an omni-directional treadmill that employs only one conveyor belt and is much simpler in nature and simpler to build. Instead of having a separate conveyor belt for each treadmill segment, the omni-directional treadmill of the present invention employs a single conveyor belt. The present invention thereby provides the advantages of not needing an elaborate method to connect end rollers to transfer movement of one belt to the next, thus eliminating the need to individually adjust tensions on a multitude of belts. This single belt is fed from one high aspect ratio cross beam to the next. All cross beams are attached to two common roller chains positioned underneath and near the end of each beam. These common roller chains then move a flat track with sprockets at each end.

The cross beams attached to the roller chains are driven by a motor connected to the sprockets the chains go around. This will be referred to herein as the X direction. Y directional movement is produced via omnidirectional wheels placed adjacent to and touching the conveyor belt as it travels around the rollers attached to the cross beam ends.

Control for the motors that power the omni-directional treadmill may be accomplished in several ways. One means would be to incorporate an infrared sensing device like an Xbox Kinect to keep track of the user's direction, speed and acceleration on the treadmill and using that information to keep the user balanced and mostly centered.

While this is most likely sufficient for movement, it deprives the user of the inertia the user would normally feel if actually moving. For instance, normally if one were to run at full speed and then abruptly stop without attempting to slow down, one would naturally fall forward or if at full speed one were to quickly change directions without leaning into the turn, one again would fall over. Of course natural balance keeps a person's feet under their center of gravity so this usually doesn't happen.

On an omni-directional treadmill however, since there is relatively little actual movement, the user would never lean into a turn or have to lean back before stopping even if running fast. This most likely would give the user an inconsistent or slightly disconnected sensation.

According to another aspect of the present invention, the omni-directional treadmill is designed such that it can tilt in both the X and Y directions. Tilting control can be tied to the speed controller, enabling the omni-directional treadmill to be programmed to tilt in proportion to a user's small acceleration. The omni-directional treadmill can be programed to tilt up in the direction of that acceleration if the user was increasing speed and down if reducing speed, tilting as high or low and lasting as long as the controlling acceleration dictates. This tilting forces the user to work a little harder just as if she actually were accelerating her own weight in the direction she was running or turning, giving her the anticipated feeling associated with acceleration.

Another or an additional way of controlling the treadmill of the present invention is to use a dynamic control interface. The illustrative control interface described here attaches the user to the machine via a swivel harness. The attachment allows the user to bend forward, sideways, jump up and pivot in any direction. It also allows her limited movement. This movement provides the controller with the user's position and acceleration. It also allows for a way of dampening her movement to simulate inertia. An additional feature of this system is that it provides a means to modify the user's apparent weight. She can weigh as much or as little as she desires via the harness interface. And still another feature is that it makes sure that the user cannot accidently run off the platform.

BRIEF DESCRIPTION OF THE DRAWING FIGURES

DETAILED DESCRIPTION

Persons of ordinary skill in the art will realize that the following description of the present invention is illustrative only and not in any way limiting. Other embodiments of the invention will readily suggest themselves to such skilled persons.

Figure 7:
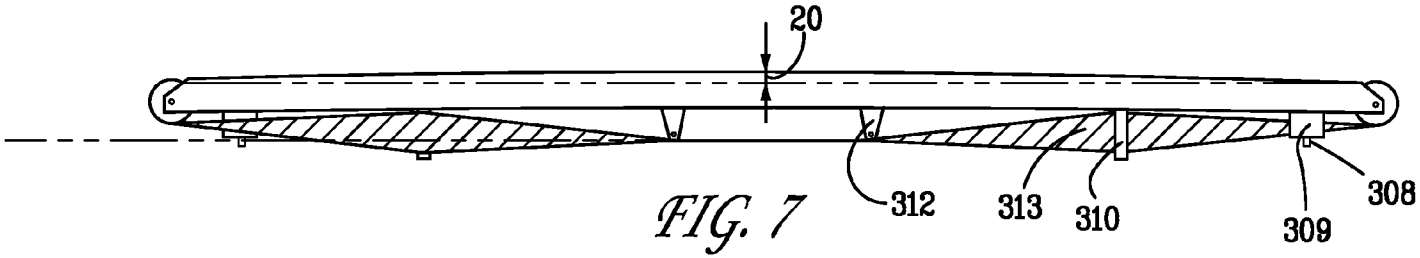
FIG. 7 is a side view of a single cross beam shown with a conveyer belt.

Construction and operation of an illustrative treadmill of the present invention is shown in the various views presented in FIGS. 1 through 7. The treadmill functions by mounting a series of cross beams 305 on two roller chains 308, one roller chain near each end of the beam as shown in FIG. 7. Cross beams 305 may be formed from a material such as aluminum. The roller chains 308 are assembled to form two parallel chains, each with a sprocket 204 on each end, the sprocket bearings being fixed to a frame 103. Movement of these beams on the chain assembly allow for movement in the x direction. For movement in the y direction, a single helically wound conveyer belt 313 is employed. Conveyor belt 313 may be formed from polyester monofilament plies with a PVC cover on the top side or equivalent materials. Conveyor belt 313 wraps around rollers 307 placed at both ends of each beam. On the outer surface of each beam the belt is kept in contact along the length of the beam by the beam employing a slight curvature shown at reference numeral 20. This curvature, which may be about 1A inch, allows for bowing of the cross beams 305 due to the user's weight without the conveyor belt 313 lifting off the surface due to a concavity.

Figure 13:
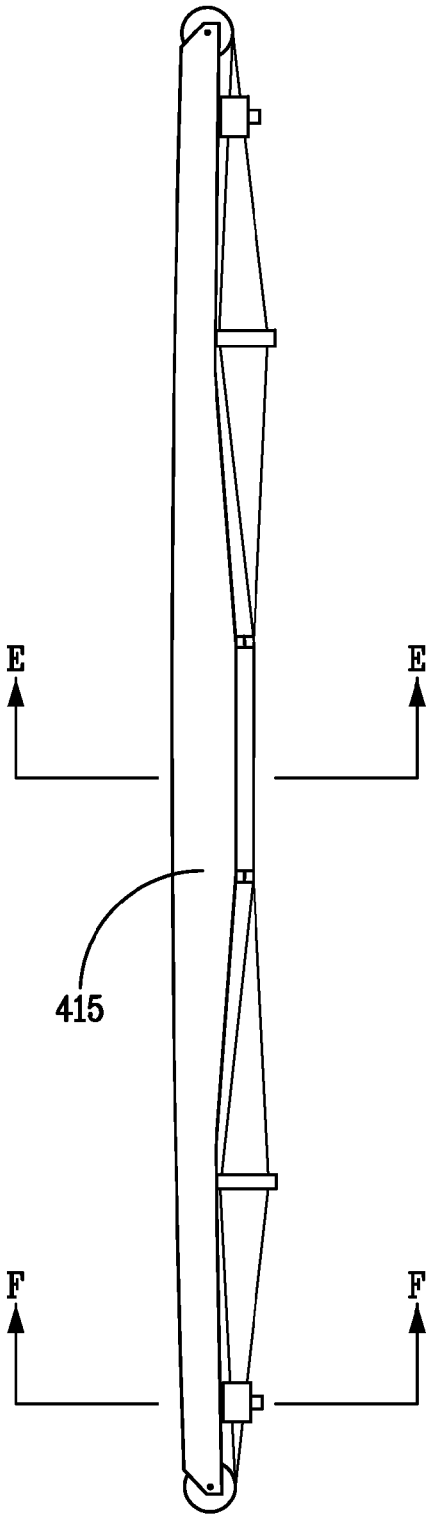
FIG. 13 is a side view of a plastic injection molded cross beam that may be used in a treadmill according to the present invention.
Figure 14:
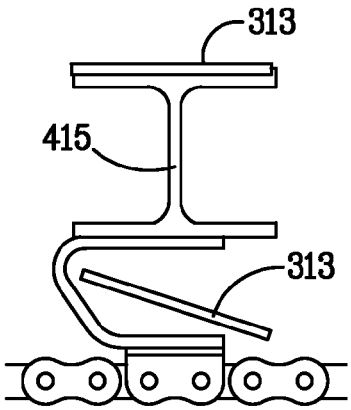
FIG. 14 is a cross-sectional view of the cross beam of FIG. 13 taken through lines F-F at the chain-attach location.
Figure 15:
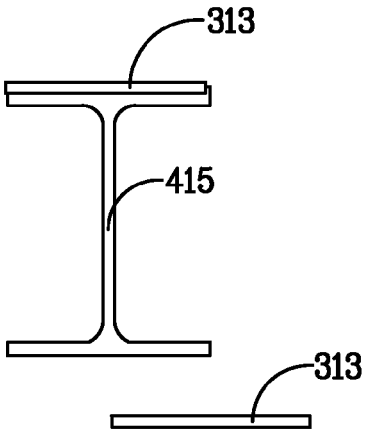
FIG. 15 is a cross-sectional view through of the cross beam of FIG. 13 taken through lines E-E at the center location showing the increased depth of the I beam.

Cross beams 305 could easily be molded from a thermoplastic plastic material such as Nylon 6/6, and may be shaped as shown at reference numeral 415 in the various views presented in FIGS. 13, 14 and 15. This version will result in a less expensive, lighter weight and easy to assemble cross beam 305.

Figure 8:
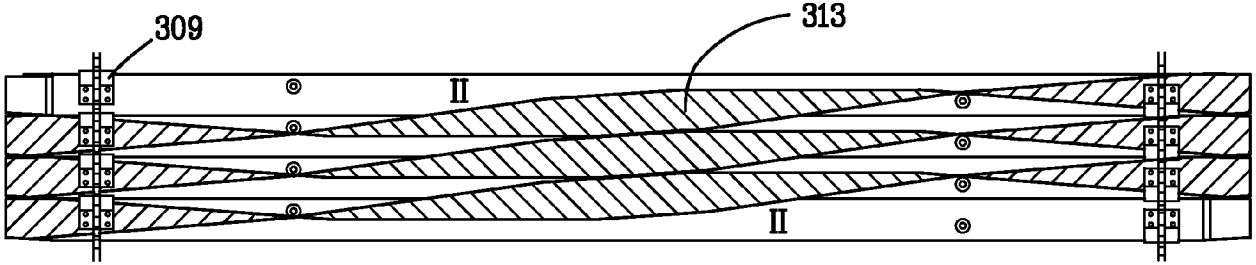
FIG. 8 is a bottom view of four cross beams shown with a conveyer belt threading from one cross beam to another.

The description of movement of the conveyor belt 313 relative to the cross beams 305 will now be described. The conveyor belt 313 travels on the outside of the beam and moves towards the end roller 307. It then travels around that roller departing it on the inside. The belt 313 then starts a twisting motion while it passes between alignment rollers 318 then through a clip 309 that attaches to the cross beam 305 then on to one of the two roller chains 308 shown in FIG. 9. It then pivots slightly around a vertically mounted roller 310 thereby slightly redirecting the belt towards the next cross beam as shown in FIG. 8. At this station, the belt has now twisted 90 degrees. The belt then continues twisting and encounters the final roller of the current beam 312. Each beam has two belt transfers going on at once. One of the rollers 312 is for the conveyer belt moving to the cross beam in front of the current cross beam and the other one of the rollers 312 is for the conveyer belt coming from the cross beam behind the current one.

The roller 312 slightly redirects the conveyor belt. Roller 312 allows the belt to stay parallel to the cross beam 305 but held at about the same height as the sprocket teeth roller chain interface. The next roller 312 the belt encounters is parallel to the last one but is mounted on the next beam over. Upon encountering that roller the belt 313 is slightly redirected back down. The belt 313 continues twisting when it encounters another roller 310 that allows it to pivot parallel to longitudinal axis of the new beam. Persons of ordinary skill in the art will note that the conveyor belt has twisted 180° between the two rollers 310. It then continues with another 90° twist again passing through a clip 309 then alignment rollers 318 mounted on alignment roller holder 317 then encounters the end roller 307 of that beam. A bottom view of this conveyer belting assembly is shown in FIG. 8. This somewhat helical wrapping of the conveyer belt 313 repeats for every beam. Therefore, only one (very long) endless conveyer belt is needed to provide y directional movement. The vertical rollers 309 are used to slightly redirect the conveyor belt allowing the end rollers 307 to be oriented exactly 90° from the length of the cross beam to allow the omnidirectional wheels to travel smoothly.

Figure 1:
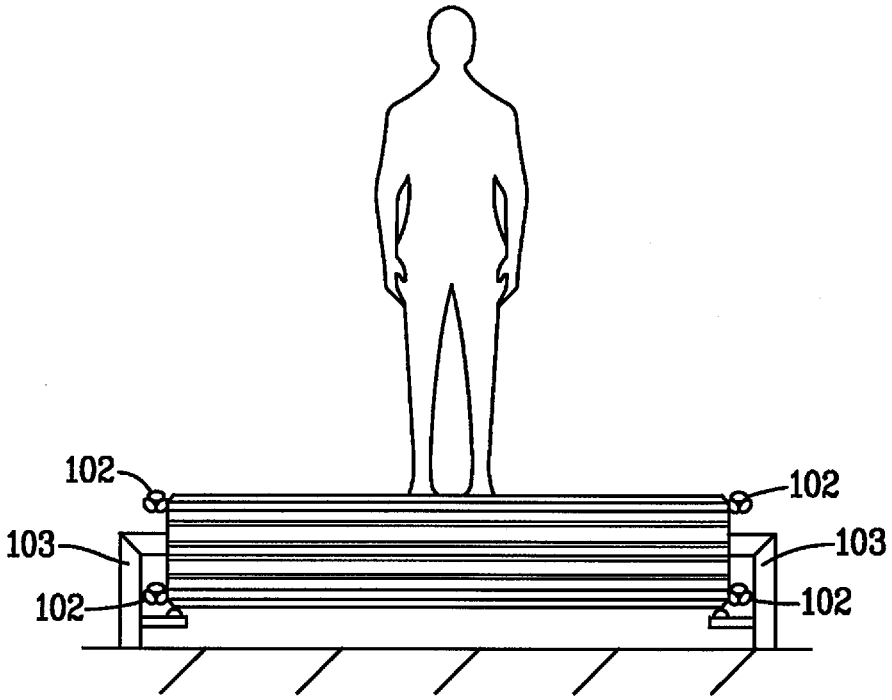
FIG. 1 is a front view of a person standing on a treadmill constructed in accordance with the present invention.
Figure 2:
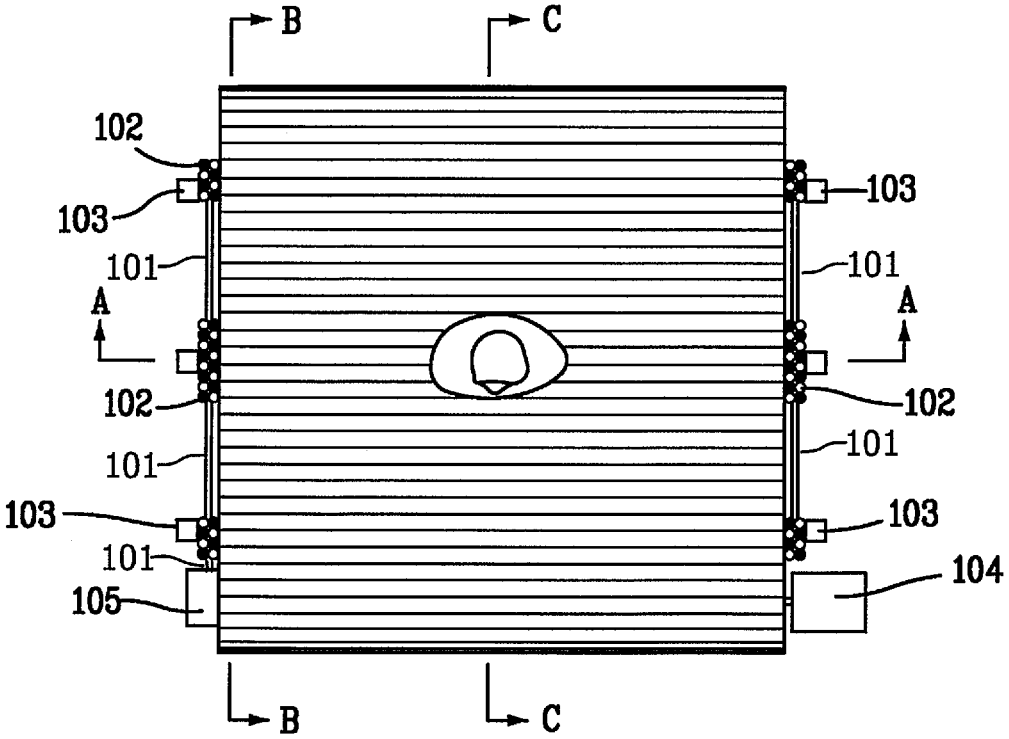
FIG. 2 is a top view of the treadmill of FIG. 1 in accordance with the present invention.
Figure 3:
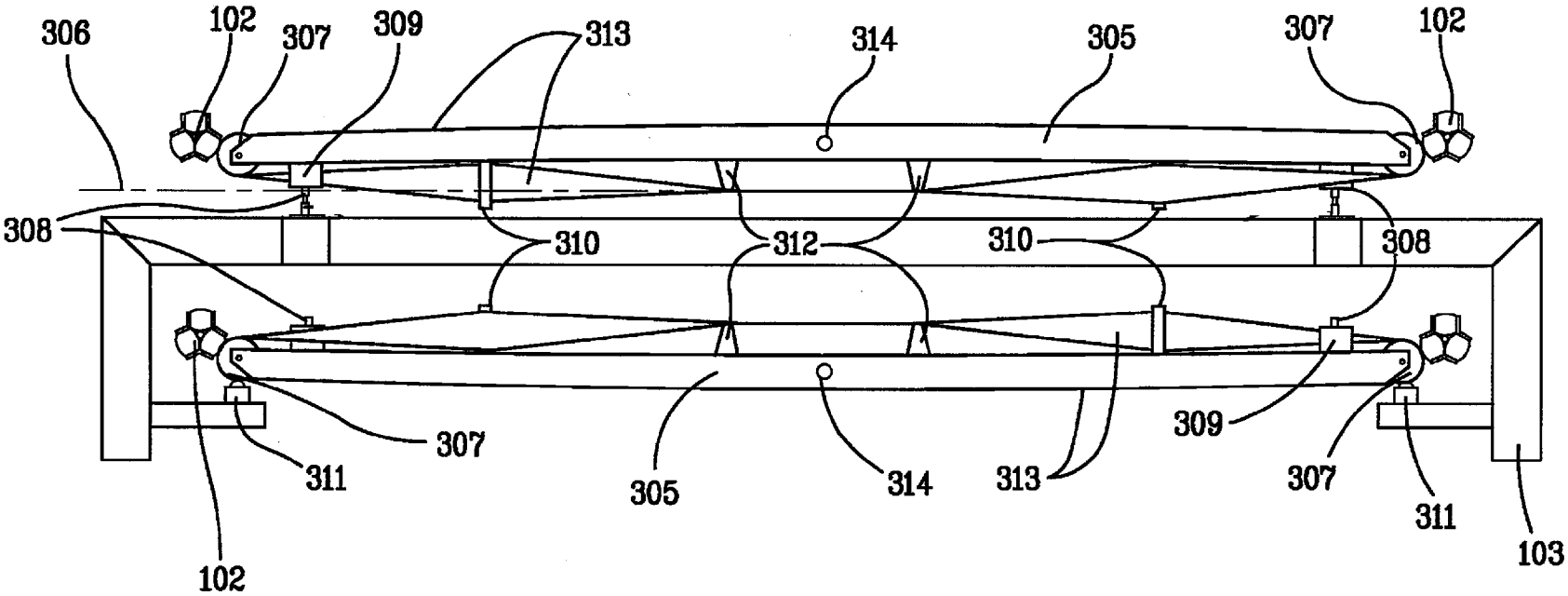
FIG. 3 is a cut away view of a treadmill in accordance with the present invention taken in a direction parallel with the cross beam of the treadmill
Figure 4:
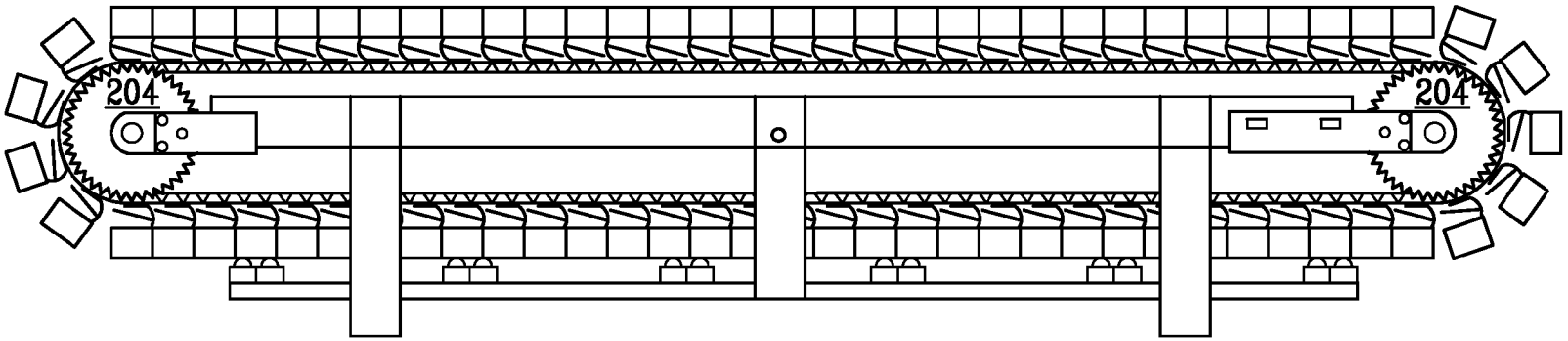
FIG. 4 is a cut away view of a treadmill in accordance with the present invention in a direction orthogonal to the direction of the cut away view of FIG. 3 showing the cross beam at the roller chain attach location.
Figure 5:
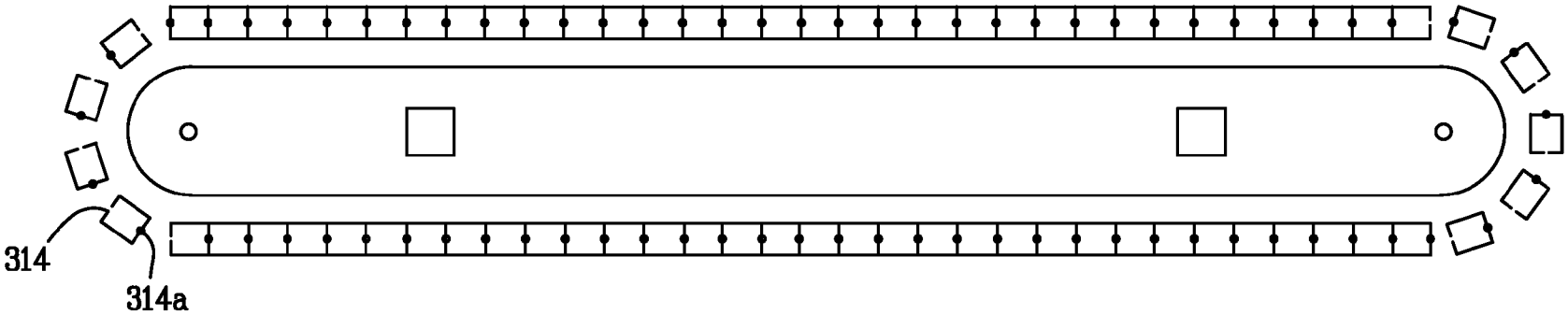
FIG. 5 is a cut away view of a treadmill in accordance with the present invention taken in the same direction as the view of FIG. 4 showing the cross beams at the middle location.
Figure 6:
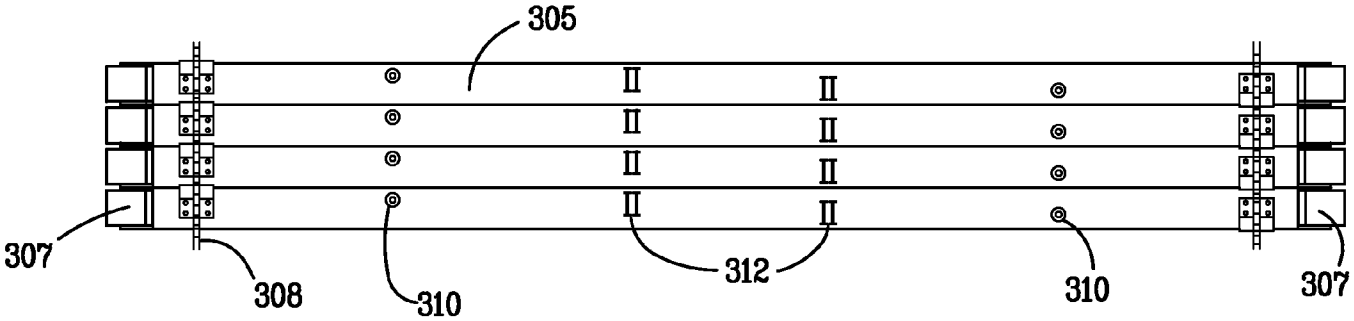
FIG. 6 is a partial bottom view of a treadmill in accordance with the present invention showing a group of four cross beams.

When the cross beam/belt assembly is at the end of the flat part of its travel when traveling in the X direction and the roller chain 308 encounters the sprocket 204 it then must rotate. The belt 313 is able to accomplish this because when traveling between cross beams at a location between the pair of rollers 312 it is at the same radius 306 as the roller chain 308 and therefore will simply twist as the two cross beams that it is passing between twist relative to each other as shown in FIGS. 4 and 5.

The X directional movement is accomplished by powering the axle coupled to the sprockets 204 with an appropriately geared electric motor 104. Y directional movement is accomplished by omni-directional wheels 102 mounted on four drive shafts 101 geared together and driven by motor 105 with each wheel 102 being pressed into the conveyor belt spinning around the end roller 307. Since each cross beam 305 has an end roller 307 on each end, inward pressures on those wheels cancel each other out, therefore the amount of pressure exerted on each wheel could be quite substantial if desired, easily enough to produce enough friction to power the conveyor belt in the Y direction, even under high acceleration. The end roller/wheel interface is stabilized by the roller chain assembly on top and ball transfers 311 on the bottom.

For additional support, the cross beams are capable of being pinned together, this may be accomplished by attaching a tapered rod 314*a* on one side of the beam and a hole 314 on the other. This will allow each cross beam to provide and get support from the neighboring cross beams on either side, thus making the assembly behave more like a homogeneous structure when the user walks on it.

Figure 9:
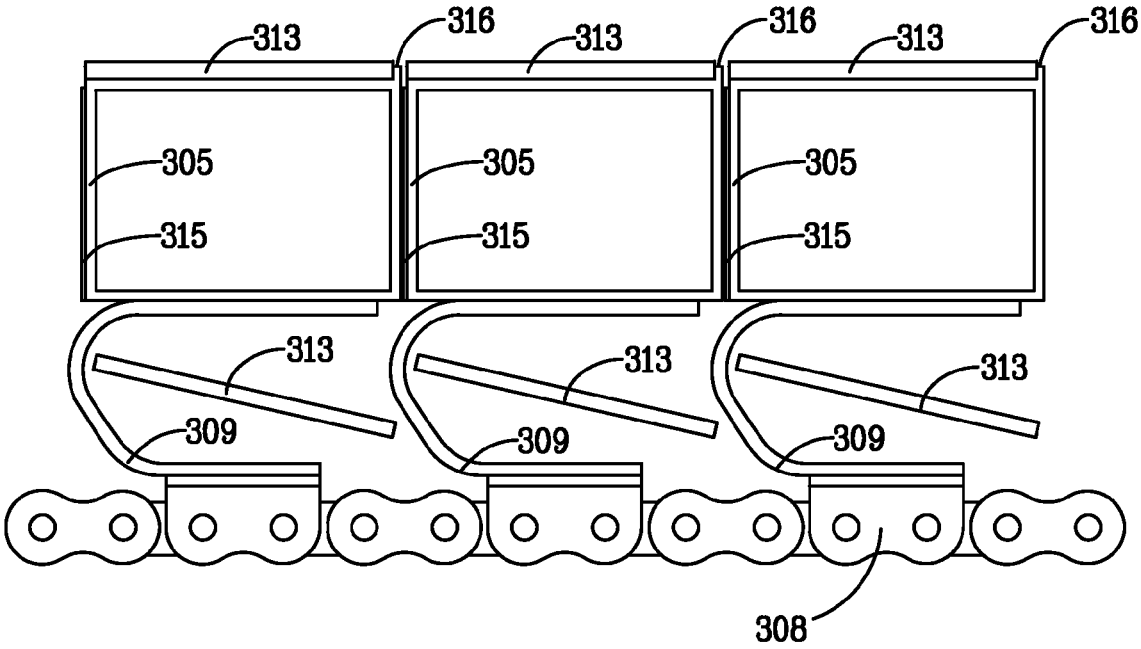
FIG. 9 is a detailed view cut through a cross beam at a location showing a clip.
Figure 10:
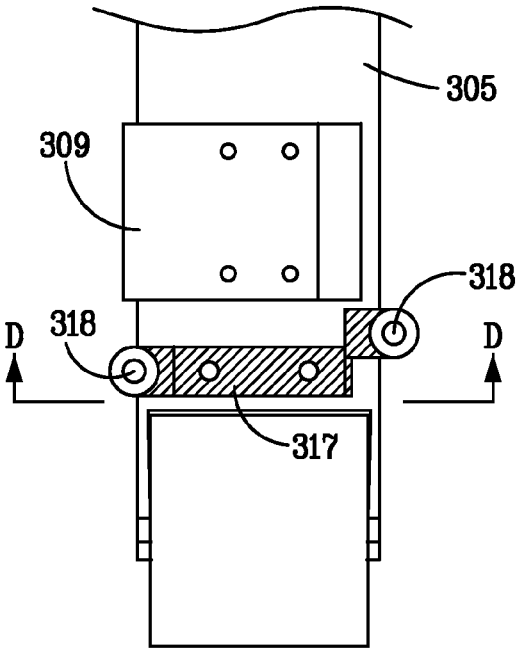
FIG. 10 is a bottom end view of a cross beam showing a guide bracket with alignment rollers attached
Figure 11:
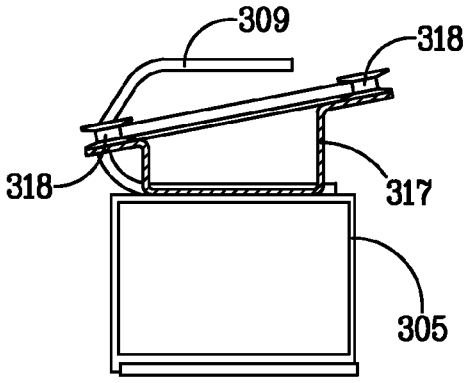
FIG. 11 is a cross-sectional view of the cross beam end of FIG. 10 next to a guide bracket taken through line D-D.
Figure 12A:
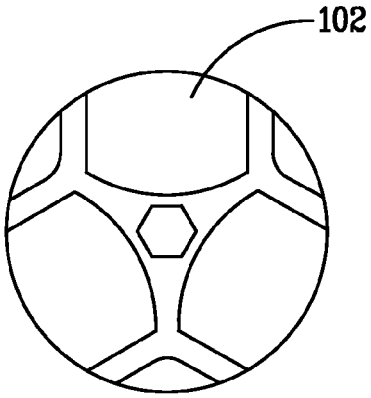
FIGS. 12A and 12B are, respectively, a side view and a front view of an omni-directional wheel.
Figure 12B:
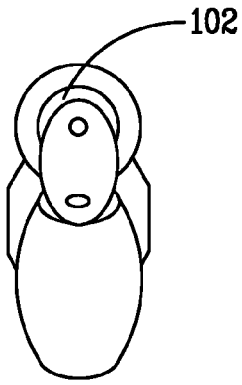

Each cross beam is also provided with a small flange 316 protruding next to the conveyer belt on one side as shown in FIG. 9. This flange 316 serves to help prevent the belt 313 from moving off the cross beam.

To help reduce noise and vibration, the interfacing sides of the cross beams with the locating pins may be fashioned to have a small gap between them. This gap is to allow for a layer of a resilient material 315 such as rubber to be attached as shown in FIG. 9.

Figure 16:
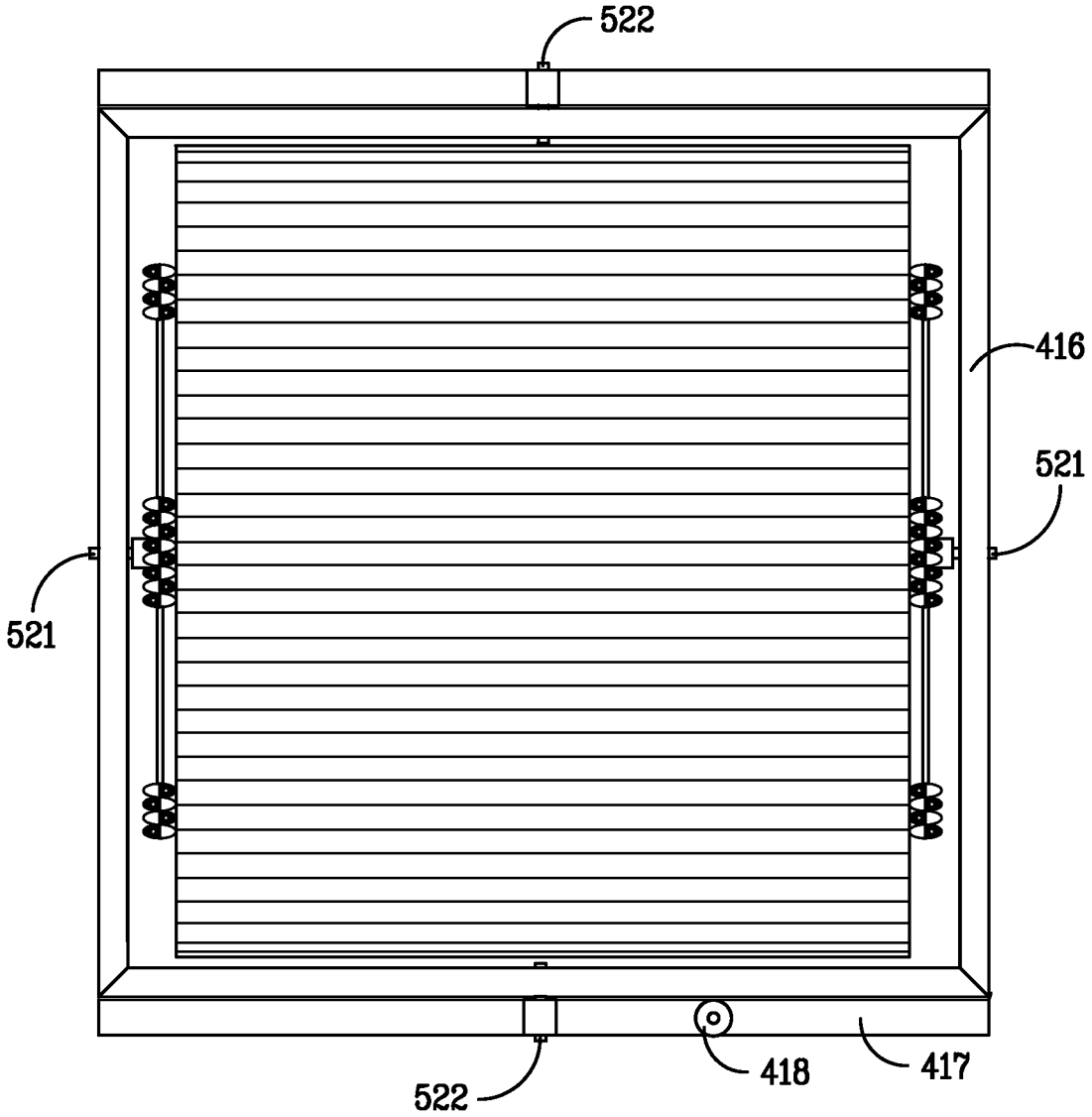
FIG. 16 is a top view of the treadmill employing a gimbal for inclining.
Figure 17:
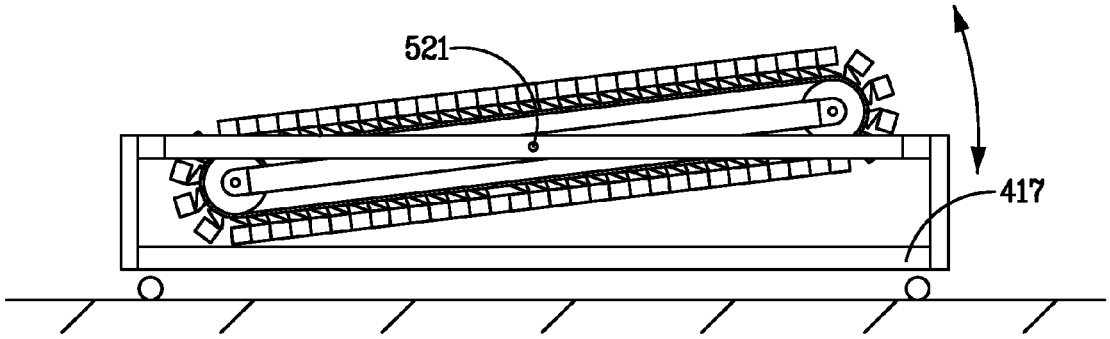
FIG. 17 is a front view of the gimbled treadmill of FIG. 16.
Figure 18:
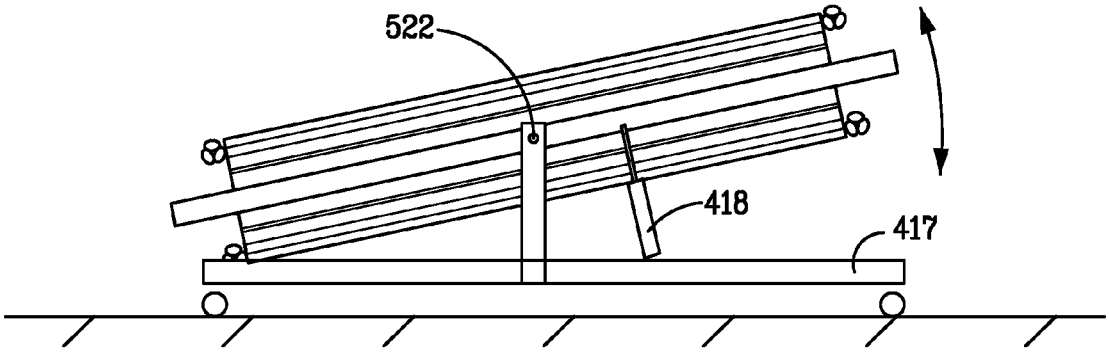
FIG. 18 is a side view of the gimbled treadmill of FIG. 16.

The omni-directional treadmill of the present invention can easily be mounted on a gimbal 416 or similar device attached to a base 417 and tilted in any direction about pivot points 521 and 522 using linear actuators 418 as shown in FIGS. 16, 17, and 18 to simulate hills and to allow for an advanced motion control device.

Figure 19:
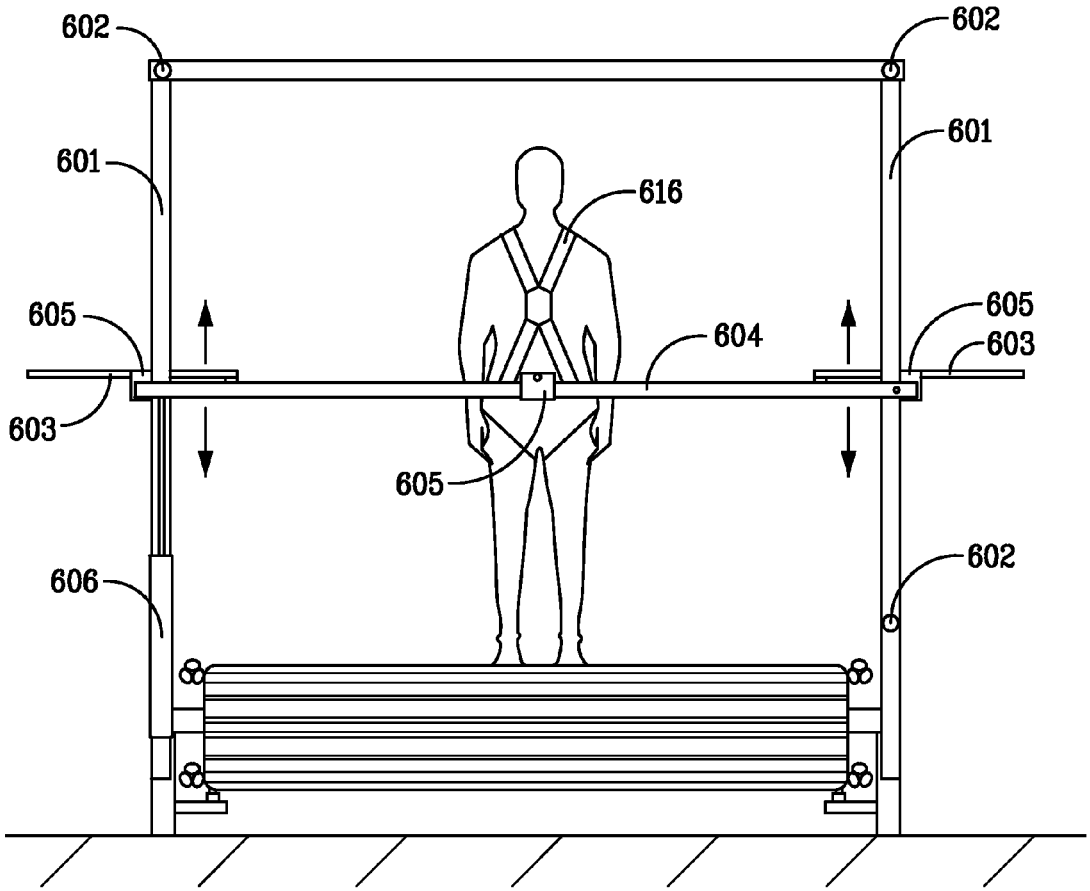
FIG. 19 is a front view of the treadmill showing a dynamic control interface attached.
Figure 20:
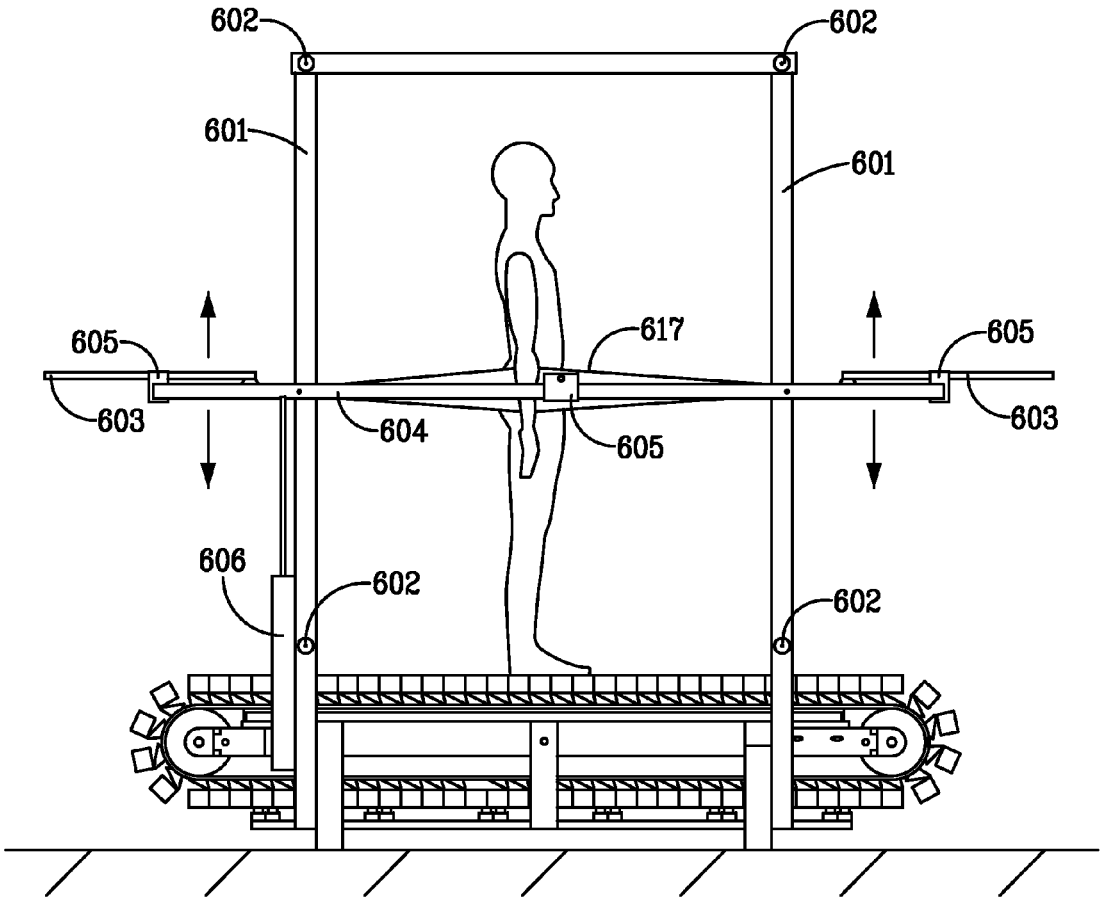
FIG. 20 is a side view of the treadmill having the dynamic control interface of FIG. 19.
Figure 21:
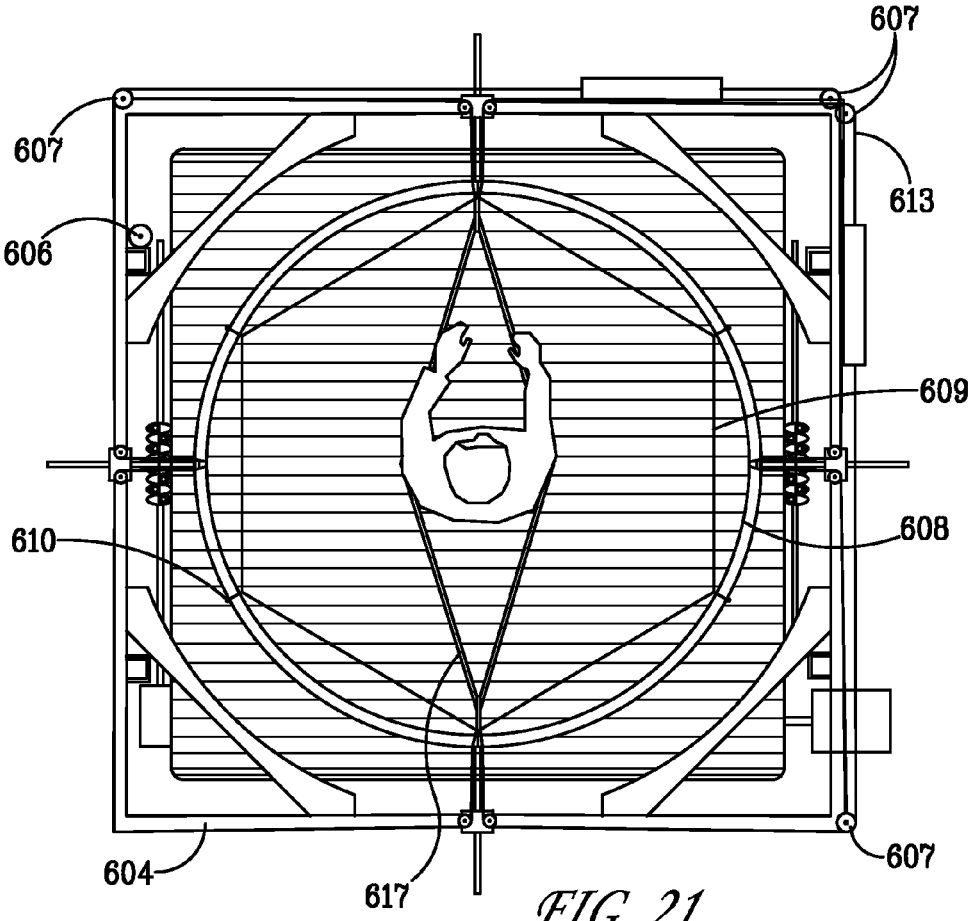
FIG. 21 is a top view of treadmill of FIG. 19.
Figure 22:
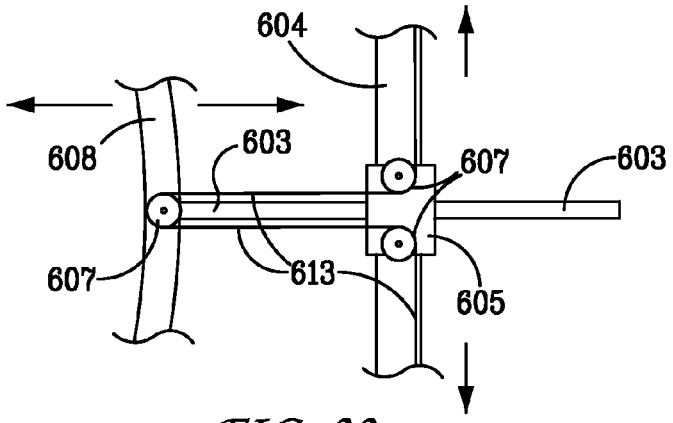
FIG. 22 is a detailed view of a hoop-frame floating connection of the dynamic control interface.
Figure 23:
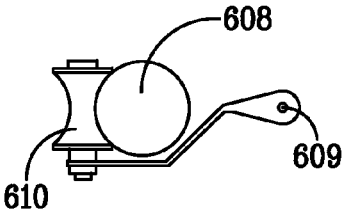
FIG. 23 is a diagram showing a hoop roller attach point of swivel harness fixture.

Referring now generally to FIGS. 19, 20, and 21, an illustrative dynamic control interface includes a floating frame 604 waist high with sliding attachments to four vertical tubes 601. There is a single cable traveling to all four of the vertical tubes via pulleys 602. This cable system forces the floating frame to stay level relative to the omni-directional treadmill. The amount of vertical force exerted on the floating frame can be controlled by a piston or actuator 606 connected to one of the vertical tubes 601.

Figure 24A:
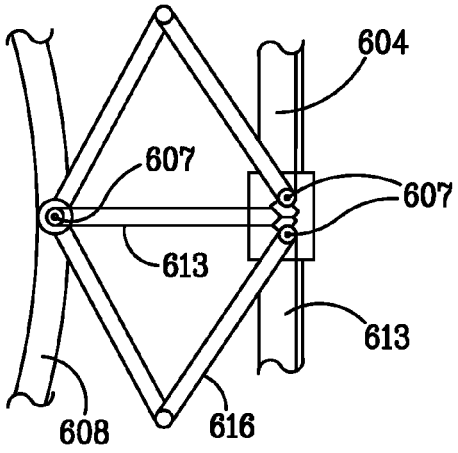
FIGS. 24A and 24B are detailed views of a scissor hoop-frame floating connection of the dynamic control interface in an extended and retracted condition, respectively.
Figure 25A:
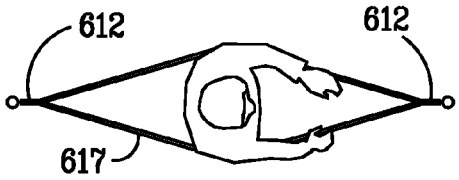
FIGS. 25A and 25B are, respectively, top and side views showing a swivel harness assembly attached to user.
Figure 24B:
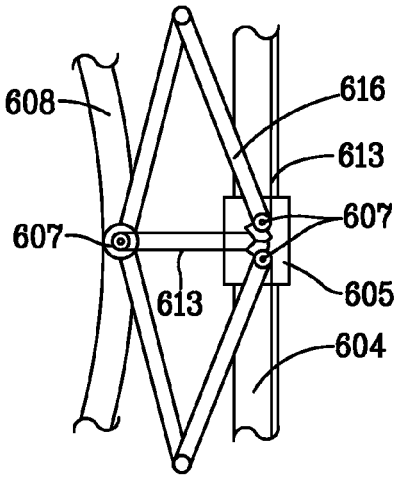
Figure 25B:
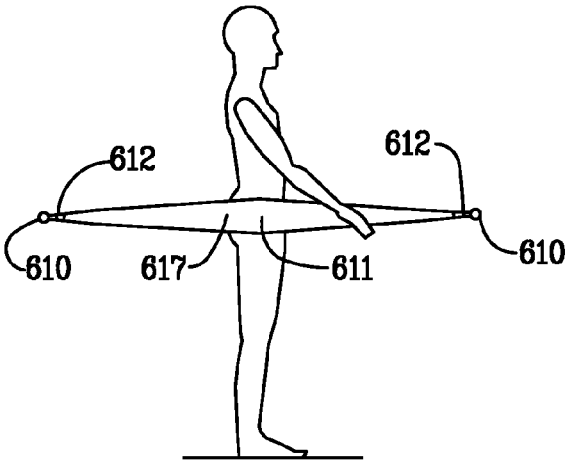

Four bearing blocks 605 glide on the floating frame allowing a means of holding a hoop via four rods 603 or other mechanism such as four scissor connections 616 as shown in FIGS. 24A and 24B. Two independent cable systems consisting of pulleys 607 and cables 613 connect one side of the hoop to the opposite side. The cables of one system translate during X directional movement and one system's cables translate during Y directional movement. These systems allows for the hoop to move in the Y direction with no X cable translation and in the X direction with no Y cable translation. The cable for each system runs through its own control unit, 614 for X and 615 for Y as shown in FIGS. 26A through 26D. The part of the cables that actually run through the control unit may be replaced by a roller chain or other means of mechanically interacting with the control unit. These units may contain an adjustable dampening device which gives the user a sense of inertia. They also easily could provide additional interfaces between the user and the speed control system of the omni-directional treadmill.

Figure 26A:
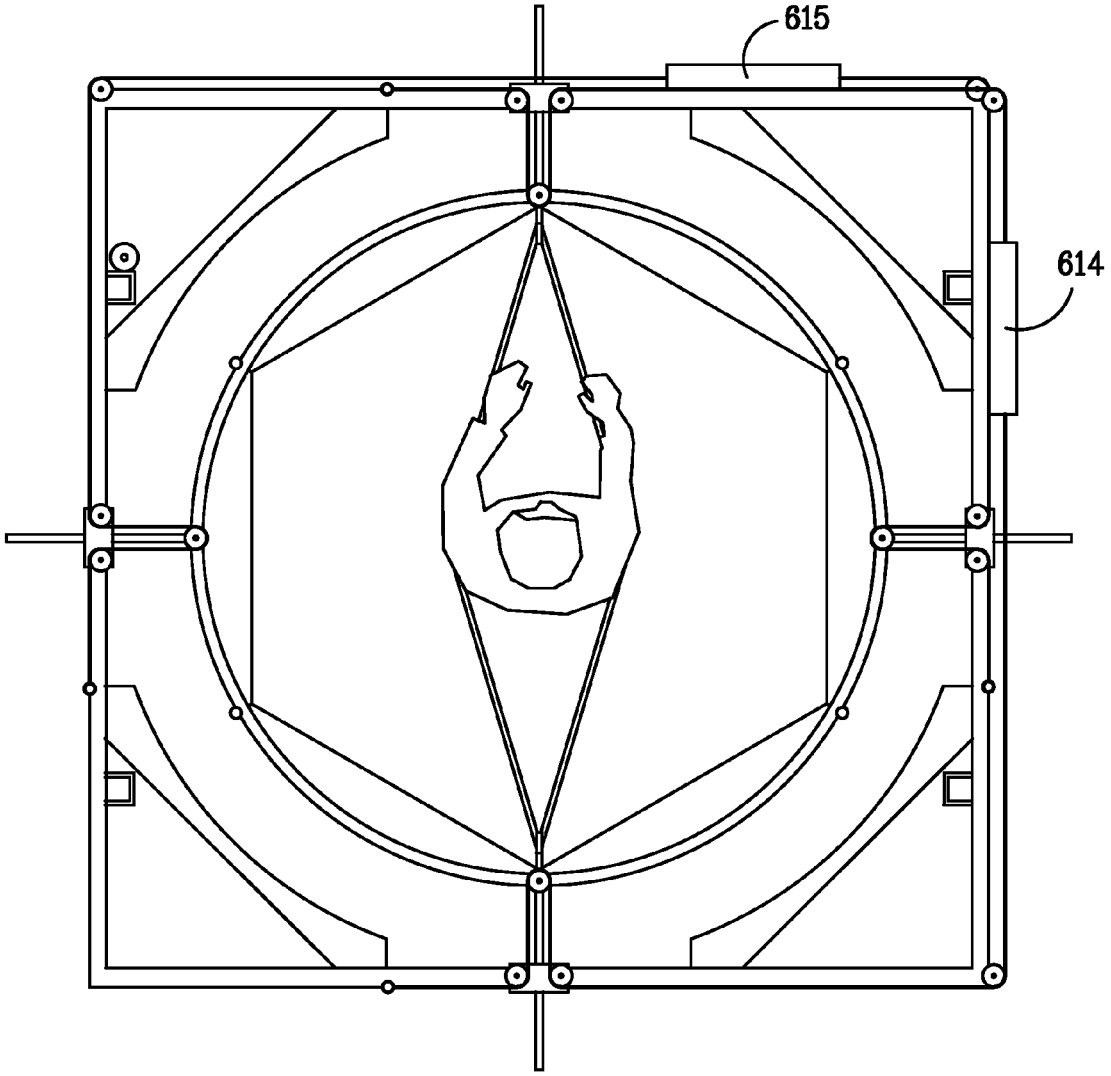
FIGS. 26A through 26D are, respectively, top views of the dynamic control interface with a user not moving, the user moving in the X direction, the user moving in the Y direction, and the user rotating.
Figure 26B:
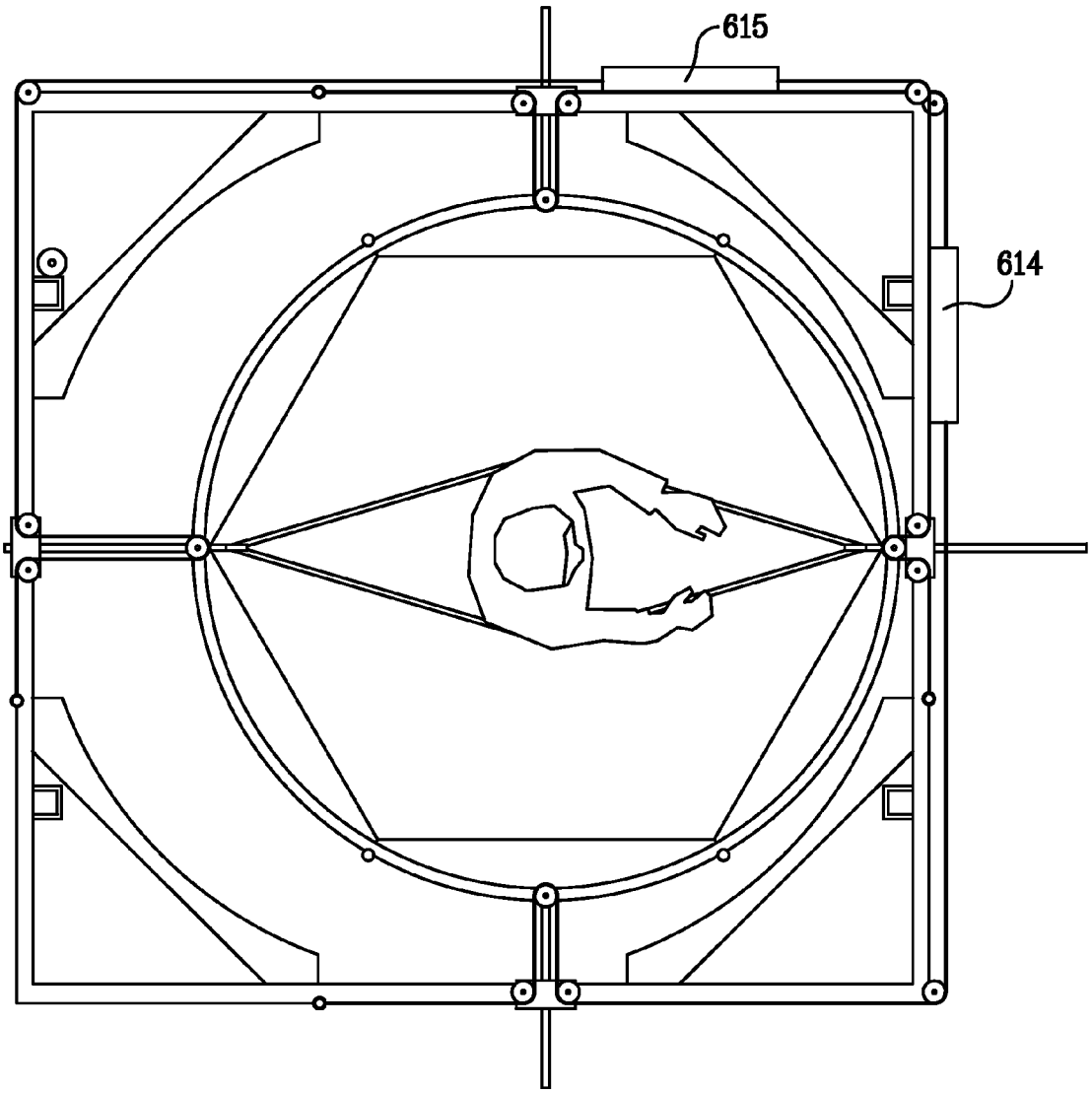
Figure 26C:
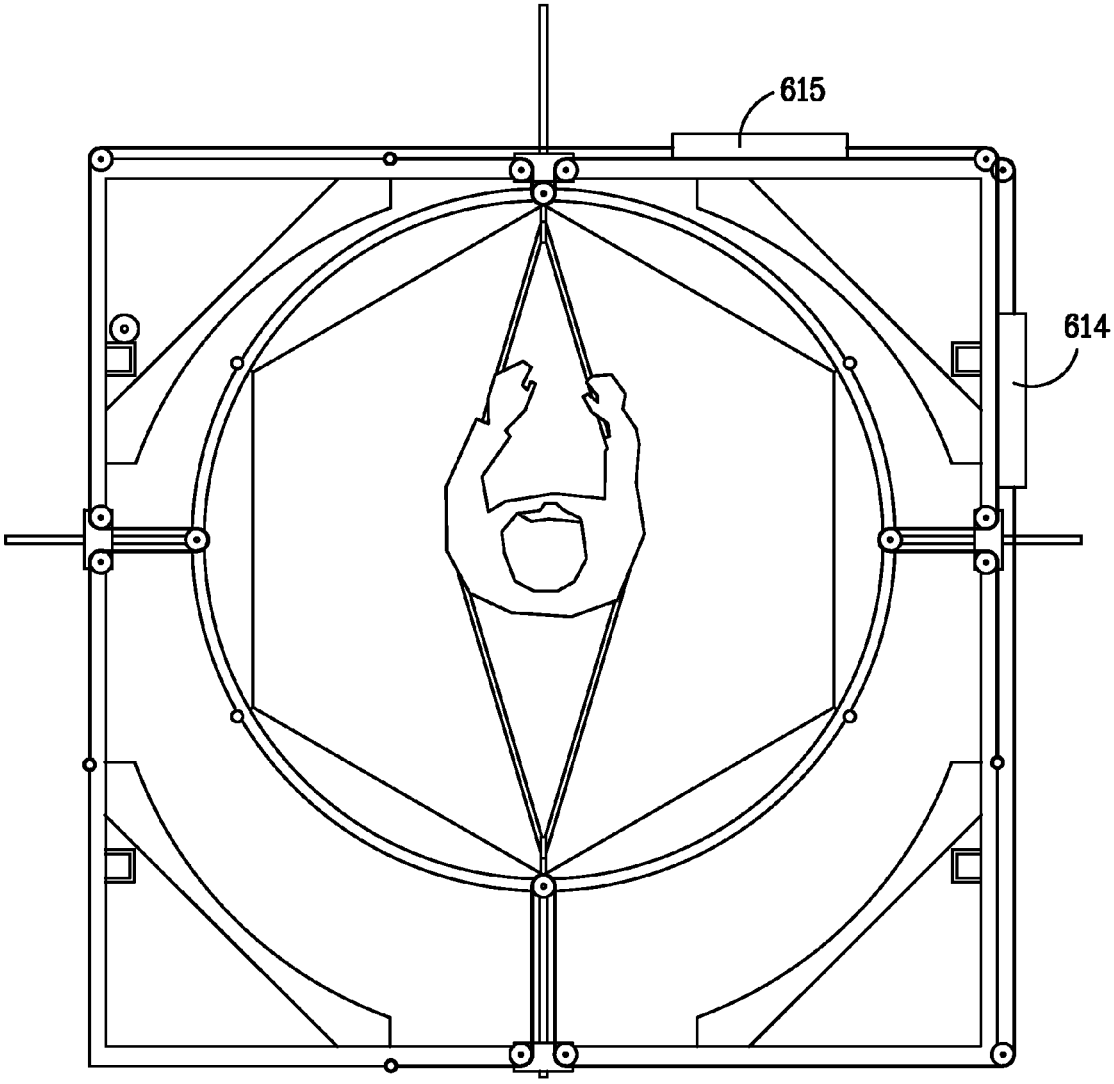
Figure 26D:
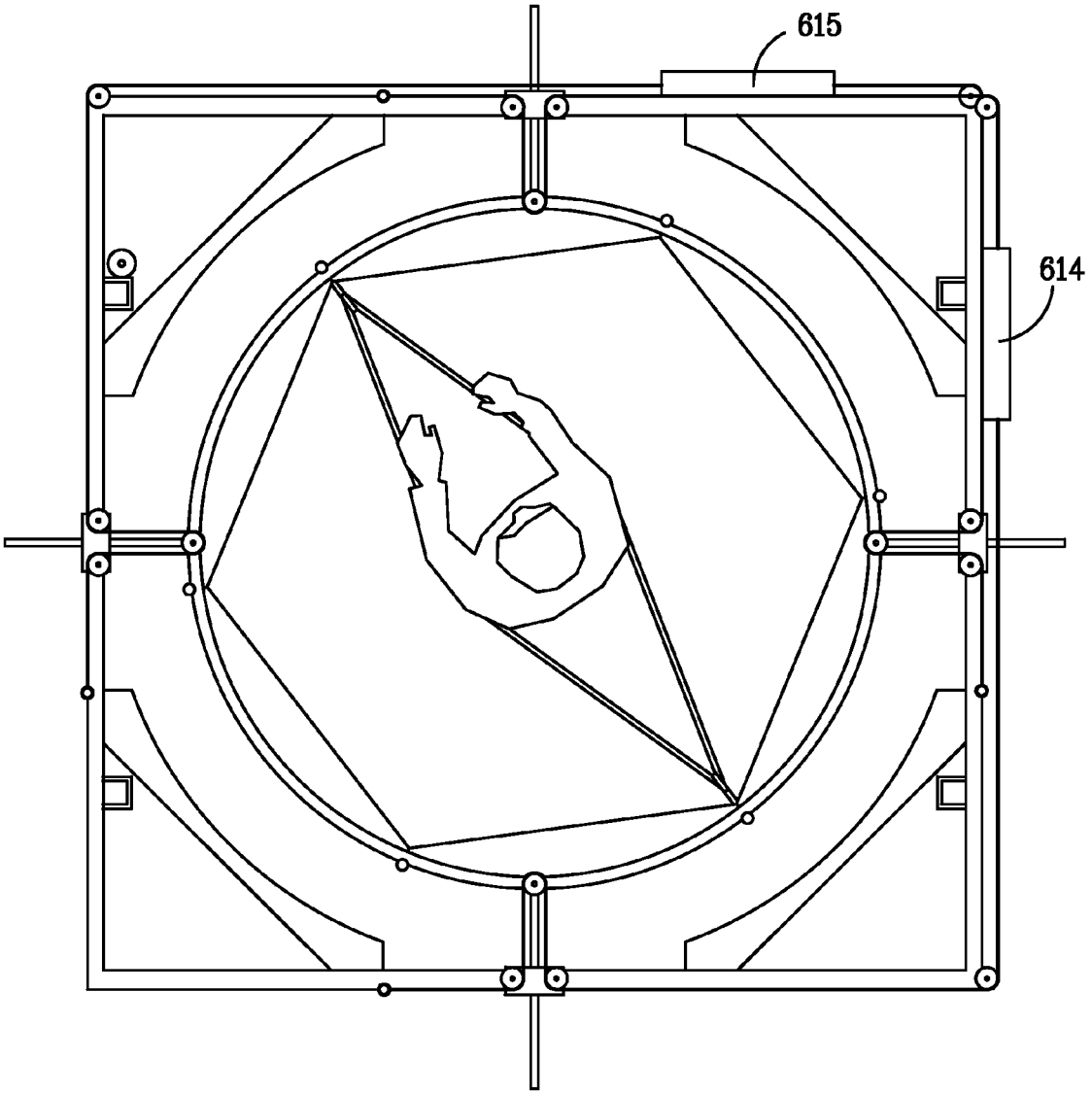

The user wears a harness 618 which incorporates two side pivot points 611 at the hip locations. These pins attach the harness to the pivot harness assembly 617. The pivot harness attaches to two hoop roller attach points through front and back swiveling connections 612. This assembly allows the user to pivot both front and back and sideways. FIG. 26A is a top view of the user in the neutral position on the treadmill. She is either not moving or in a steady state of movement. FIG. 26B is also a top view and shows the user in a movement in the X direction with a translation in that direction. FIG. 26C is a top view showing the user moving in the Y direction with a translation in that direction. The assembly is also capable of twisting inside the hoop 608 via hoop rollers 610 and cable 609 thus allowing the user to turn as shown in FIG. 26D.

Due to the nature of the dynamic control interface, when the user is connected in, she can be made to feel any weight sensation desirable by applying the appropriate force through the vertical actuator 606. This actuator could be a pneumatic or hydraulic piston connected to a plenum pressurized by a gas. By controlling the gas pressure, someone on the Earth could feel like they were on the Moon or someone on the Moon or in space could feel as if they weighed as much as they desired.

To connect to the dynamic control interface, the user first needs to be wearing the harness 618 then, with the swivel harness fixture lowered, simply step into it, pull it up and snap in to the side pivot points 611.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. An omnidirectional treadmill comprising:

a frame;

a plurality of cross beams coupled to one another to form a continuous loop having a substantially flat upper surface, each of the plurality of cross beams having an inner surface and an outer surface;

a cross-beam drive mechanism mounted to the frame and coupled to the plurality of cross beams to drive the continuous loop;

a single conveyor belt passing across the outer surface of each cross beam and helically passing from a first end of the inner surface of each cross beam to a second opposite end of the inner surface of an adjacent cross beam; and a conveyor-belt drive mechanism coupled to the conveyor belt.

2. The omnidirectional treadmill of claim 1 wherein the plurality of cross beams are coupled to one another by being mounted on first and second drive chains, the first drive chain mounted between a first pair of sprocketed wheels and the second drive chain mounted between a second pair of sprocketed wheels, a first end of each cross beam mounted to the first drive chain and a second end of each cross beam mounted to the second drive chain, opposing ones of the first and second pair of sprocketed wheels each mounted on a common axle supported by an axle frame coupled to the frame.

3. The omnidirectional treadmill of claim 2 wherein the cross-beam drive mechanism comprises a drive motor coupled to one of the common axles of the sprocketed wheels.

4. The omnidirectional treadmill of claim 1 wherein each cross beam has a hole formed in one side face at a selected position along its length and a rod extending out of a second face opposing the first face at the selected position, the rod of each cross beam extending into the hole of an adjacent cross beam.

5. The omnidirectional treadmill of claim 1 wherein the conveyor-belt drive mechanism comprises a belt drive motor coupled to the single conveyor belt.

6. The omnidirectional treadmill of claim 2 further comprising a tilt actuator coupled between the frame and the axle frame to tilt the substantially flat upper surface of the continuous loop at an angle disposed from a horizontal plane.

7. The omnidirectional treadmill of claim 6 wherein the axle frame is mounted to the frame at a pair of opposed pivot points.

8. The omnidirectional treadmill of claim 1 further comprising a user harness mounted to the frame.

9. The omnidirectional treadmill of claim 1 further comprising:

a dynamic control interface including a floating frame having sliding attachments to four vertical supports, a single cable traveling to all four of the vertical supports via pulleys to force the floating frame to remain level relative to the omnidirectional treadmill; and an actuator coupled to one of the vertical supports to control the amount of vertical force exerted on the floating frame.

* * * * *